United States Patent [19]

Cuff et al.

[11] Patent Number: 4,534,562

[45] Date of Patent: Aug. 13, 1985

[54] PLAYING CARD CODING SYSTEM AND APPARATUS FOR DEALING CODED CARDS

[75] Inventors: Richard A. Cuff, Rosemont; Paul R. Hoffman, Exton, both of Pa.

[73] Assignee: Tyler Griffin Company, Paoli, Pa.

[21] Appl. No.: 502,050

[22] Filed: Jun. 7, 1983

[51] Int. Cl.[3] ..... A63F 1/14

[52] U.S. Cl. ..... 273/149 P; 273/149 R; 273/151

[58] Field of Search ..... 273/292–308, 273/149 R, 149 P, 148 R, 148 A, 150, 151; 235/435, 437, 465, 487, 494, 375, 380, 454–456, 462; 209/547, 563, 564, 608, 576–580, 587; 371/38

[56] References Cited

U.S. PATENT DOCUMENTS

| | | | |
|---|---|---|---|
| 2,760,779 | 1/1951 | Ogden et al. . | |
| 2,766,989 | 10/1956 | Sivertson . | |
| 3,147,978 | 9/1964 | Sjostrand . | |
| 3,179,001 | 4/1965 | Silverman . | |
| 3,222,071 | 12/1965 | Lang | 273/149 P |
| 3,312,473 | 4/1967 | Friedman et al. . | |
| 3,426,179 | 2/1969 | Grimm et al. . | |
| 3,489,907 | 1/1970 | Kenez | 273/149 P |
| 3,529,829 | 9/1970 | Seifert . | |
| 3,648,242 | 3/1972 | Grosbard . | |
| 3,658,342 | 4/1972 | Boren . | |
| 3,679,876 | 7/1972 | Faith et al. . | |
| 3,690,670 | 9/1972 | Cassady et al. | 273/149 P |
| 3,731,936 | 5/1973 | Copeland . | |
| 3,751,041 | 8/1973 | Seifert . | |
| 3,768,813 | 10/1973 | Reynolds . | |
| 3,791,516 | 2/1974 | Tramposch | 209/563 |
| 3,814,436 | 6/1974 | Boren . | |
| 3,822,376 | 7/1974 | Kok et al. . | |
| 3,858,797 | 1/1975 | Takeuchi . | |
| 3,897,954 | 8/1975 | Sheet . | |
| 3,929,339 | 12/1975 | Mattioli . | |
| 3,944,230 | 3/1976 | Fineman . | |
| 4,237,375 | 12/1980 | Granholm | 235/456 |
| 4,277,844 | 7/1981 | Hancock et al. | 371/38 |
| 4,310,160 | 1/1982 | Willette et al. . | |

*Primary Examiner*—Richard C. Pinkham
*Assistant Examiner*—Vincent A. Mosconi
*Attorney, Agent, or Firm*—Panitch Schwarze Jacobs & Nadel

[57] ABSTRACT

Playing cards are marked with binary codes adjacent both side edges of the face of each card in a standard deck. The code includes a precode which signals a card reader to read the code in proper bit sequence depending on the direction of card movement past the reader. The binary code includes six bits to represent face value and suit of the card, and a four-bit error detection code which can detect errors of two bits in the code.

A deck of coded cards is dealt either manually or automatically according to at least one predetermined program. The coded cards are passed over photocells which read the binary codes on the face of the card. The photocell outputs are sent to a microprocessor, which compares the code to the predetermined program and directs the card to the appropriate player location.

6 Claims, 17 Drawing Figures

SHUFFLING SUBROUTINE

PLAYING CARD CODING SYSTEM AND APPARATUS FOR DEALING CODED CARDS

BACKGROUND OF THE INVENTION

Card games have been played and enjoyed by millions with undiminished popularity for thousands of years. Today, most games enthusiasts consider the game of Contract Bridge to be the ultimate test of a card-player's skill. With an estimated 30 million players in America and similarly staggering figures in most Western countries, Bridge is almost certainly the most played game in the world today.

In Contract Bridge, the cards are shuffled and dealt to each of the players, whereupon the players then bid for the "contract" and play the hand accordingly. Scoring takes place as the points from individual played hands or deals make up game scores which, in turn, contribute toward the "rubber" score and the final tally. While the game requires a great deal of skill and imagination to win consistently, the "luck of the deal" can be a large factor. That is, when the better cards fall to one of the partnerships, that partnership will have an opportunity to score highly even though the partners may not be particularly skilled players.

The game of "Duplicate Bridge" was developed to eliminate the luck of the deal by causing the same deal to be played two or more times at different tables. This is the form of Bridge which is played in nearly all Bridge tournaments and provides a contest wherein the score is more a result of the player's skill than luck. In effect, all participating partners are made to play the same identical hands which their competitors play and the point gain, and thus the measure of skill, can then be made by comparing the scores of both the playing and defending partners with the results achieved by other foursomes. The Bridge hands after being bid and played by one foursome are kept in the same order, by not intermixing the cards, and are passed to the next foursome for bidding and play. This procedure is repeated until all the hands are played by each of the contestant foursomes. Scoring can then be made on the basis of what a foursome, both the playing and defending partners, did on a particular dealt hand relative to the results of all other competing foursomes.

The present invention facilitates the dealing of cards for the game of Duplicate Bridge in that cards may be dealt in a predetermined manner by use of individual code marks printed on the face side of the cards. The invention facilitates the play of Duplicate Bridge since the cards no longer need to be kept separate by player when passing the cards from table to table during tournament play. With this invention, the same hand can be dealt from any deck of coded cards as many times as required. Many different hands can be stored in a memory and called for dealing as often as desired. Hands which illustrate a certain point of the game can be stored and dealt quickly to aid in Bridge instruction. In addition, hands from famous tournaments can be dealt and played with the result compared to how the hand was originally bid and played by the experts.

SUMMARY OF THE INVENTION

The present invention includes a system for coding playing cards comprising a plurality of playing cards having machine-readable card-identifying indicia on the face of each card in addition to human-readable indicia. The machine-readable indicia are in the form of a binary code which constitutes a binary word corresponding to the identity of the card. The indicia representing binary ones are arranged along one side edge of the face of the card, and the indicia representing binary zeros are arranged along the opposite side edge of the face of the card. Machine-readable card orientation indicia are provided on the face of each card to identify the side edge of the face of the card which bears the binary ones indicia and the side edge which bears the binary zeros indicia.

The coding system may also include an error code for preventing errors in reading the indicia.

The invention also includes apparatus for dealing coded playing cards in accordance with at least one predetermined hand. In one embodiment, the apparatus comprises a housing with an opening for introducing at least one coded playing card into the apparatus, means for electro-optically reading the coded cards one at a time as the coded cards are moved manually past the reading means, card guide means operatively associated with the reading means for guiding only one card at a time past the reading means, means for comparing the code read from each card against the predetermined hand to determine to which player position the card should be dealt, and indicating means to provide a visual indication of which player position the card should be dealt to.

In a second embodiment, the apparatus automatically deals coded playing cards in accordance with at least one predetermined hand, and comprises a housing with an opening for inserting a deck of coded playing cards, means for electro-optically reading the coded cards one at a time as the coded cards move past the reading means, card guide means operatively associated with the reading means for guiding only one card at a time past the reading means, means for automatically introducing the cards one at a time into the guide means, means for comparing the code read from each card against the predetermined hand to determine to which player position the card should be dealt and to generate a control signal representative of that player location, and distributor means responsive to the control signal for receiving the card from the card guide means and moving the card to the appropriate player location.

Although the present invention is particularly useful in connection with the game of Duplicate Bridge, it should be appreciated that the invention is not limited to any particular card game, and can be used to advantage in many card games.

DESCRIPTION OF THE DRAWINGS

For the purpose of illustrating the invention, there is shown in the drawings forms which are presently preferred; it being understood, however, that the invention is not limited to the precise arrangements and instrumentalities shown.

DETAILED DESCRIPTION OF THE INVENTION

Card Coding

Figure 1:
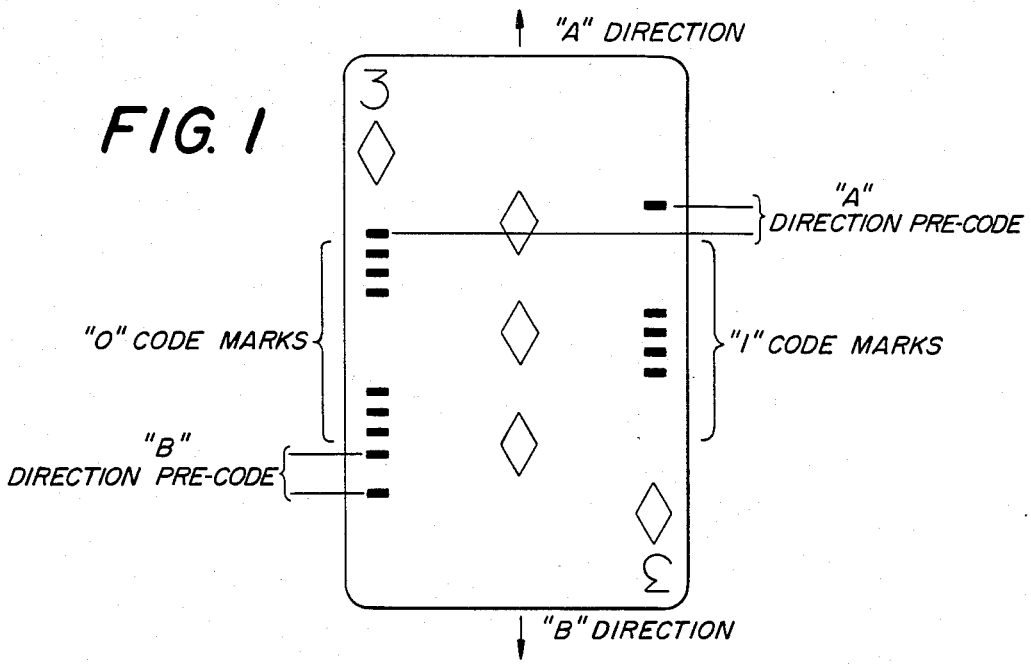
FIG. 1 illustrates a playing card coded in accordance with the coding system of the present invention.

Referring now to the drawings, there is shown in FIG. 1 a representative playing card coded in accordance with the system of the present invention. For purposes of illustration, the three of diamonds of a standard deck has been chosen as an example. However, it should be appreciated that the coding system of the present invention is equally adaptable to all forms of playing cards and is not limited to any one style of cards.

As shown in FIG. 1, playing cards are marked with bar codes along each side edge of the face of the card. The bar codes are shown as black rectangles in FIG. 1. The black rectangles represent binary digits, or bits, of a binary word. As presently preferred, the coding system is simple binary, but any other method of binary coding, such as BCD, may be used without departing from the scope of the present invention. For coding, the cards are arranged from ace of spades to king of clubs and are assigned a binary word to encode the face value and suit of the card. Six bits are presently preferred, but any number of bits sufficient to encode face value and suit can be used.

By way of example and not limitation, four bits may be used to encode card face value, and two bits may be used to encode suit as follows:

| Bit | Card Value | | | | | | | | | | | | |
|---|---|---|---|---|---|---|---|---|---|---|---|---|---|
| | A | 2 | 3 | 4 | 5 | 6 | 7 | 8 | 9 | 10 | J | Q | K |
| 1 | 0 | 0 | 0 | 0 | 0 | 0 | 0 | 1 | 1 | 1 | 1 | 1 | 1 |
| 2 | 0 | 0 | 0 | 1 | 1 | 1 | 1 | 0 | 0 | 0 | 0 | 1 | 1 |
| 3 | 0 | 1 | 1 | 0 | 0 | 1 | 1 | 0 | 0 | 1 | 1 | 0 | 0 |
| 4 | 1 | 0 | 1 | 0 | 1 | 0 | 1 | 0 | 1 | 0 | 1 | 0 | 1 |

| | Suit | | | |
|---|---|---|---|---|
| | Spades | Hearts | Diamonds | Clubs |
| 5 | 0 | 0 | 1 | 1 |
| 6 | 0 | 1 | 0 | 1 |

Thus, for the three of diamonds illustrated in FIG. 1, the binary word is 001110. For the Jack of hearts, the word in 101101, and so forth.

The binary code may also include an error code. As presently preferred, a Hamming error code, constructed to detect errors of two bits in the binary word is used. Hamming error codes are well-known and will be understood by persons of skill in the art.

To illustrate the use of the error code, for example, the format of the data word may be:

| | | | | | | | | | |
|---|---|---|---|---|---|---|---|---|---|
| P | P | D | P | D | D | D | P | D | D |
| P0 | P1 | D0 | P2 | D1 | D2 | D3 | P3 | D4 | D5 |

where P signifies an error detecting bit and D signifies a data bit. The error detecting bits form a Hamming error code so that P0 results in even parity on data bits D0, D1, D3 and D4, P1 results in even parity on data bits D0, D2, D3 and D5, P2 results in even parity on data bits D1, D2 and D3, and P4 results in even parity on data bits D4 and D5. It can be seen that each data bit is covered by at least two error detecting bits, thus:

| | | |
|---|---|---|
| D0 | covered by | P0, P1 |
| D1 | covered by | P0, P2 |
| D2 | covered by | P1, P2 |
| D3 | covered by | P0, P1, P2 |
| D4 | covered by | P0, P3 |
| D5 | covered by | P1, P3 |

Hence, any one bit or two bit error in reading the coded card will be detected.

As shown in FIG. 1, bars representing binary zeros are located along one side edge of the face of the card, while bars representing binary ones are located along the opposite side edge of the face of the card. The arrangement of ones and zeros on opposite side edges is advantageous since, as explained more fully below in connection with the card dealing apparatus, the speed of the card past the reader does not become a factor. Thus, timing problems, and potential errors in reading the code, are avoided.

In addition to bars which make up the binary word identifying the card and the Hamming error code, bars for direction precode are also marked on the face of the card. The direction precode is used to indicate the orientation of the card with respect to the card reader, as described in greater detail below. In FIG. 1, the direction precodes are arranged along the side edges of the face of the card adjacent the code for the binary word which identifies the card. However, the direction precode may be placed at any other suitable location on the card face, for example, along the top and bottom edges of the face of the card.

Card Dealing Apparatus

The Manual Dealer

One embodiment of a card dealing apparatus in accordance with the present invention is shown in FIGS. 2–6. For convenience, this embodiment of the invention will be referred to as a manual dealer, since cards are moved manually through the dealer and manually dealt to the appropriate player location.

Figures 2, 3, 6:
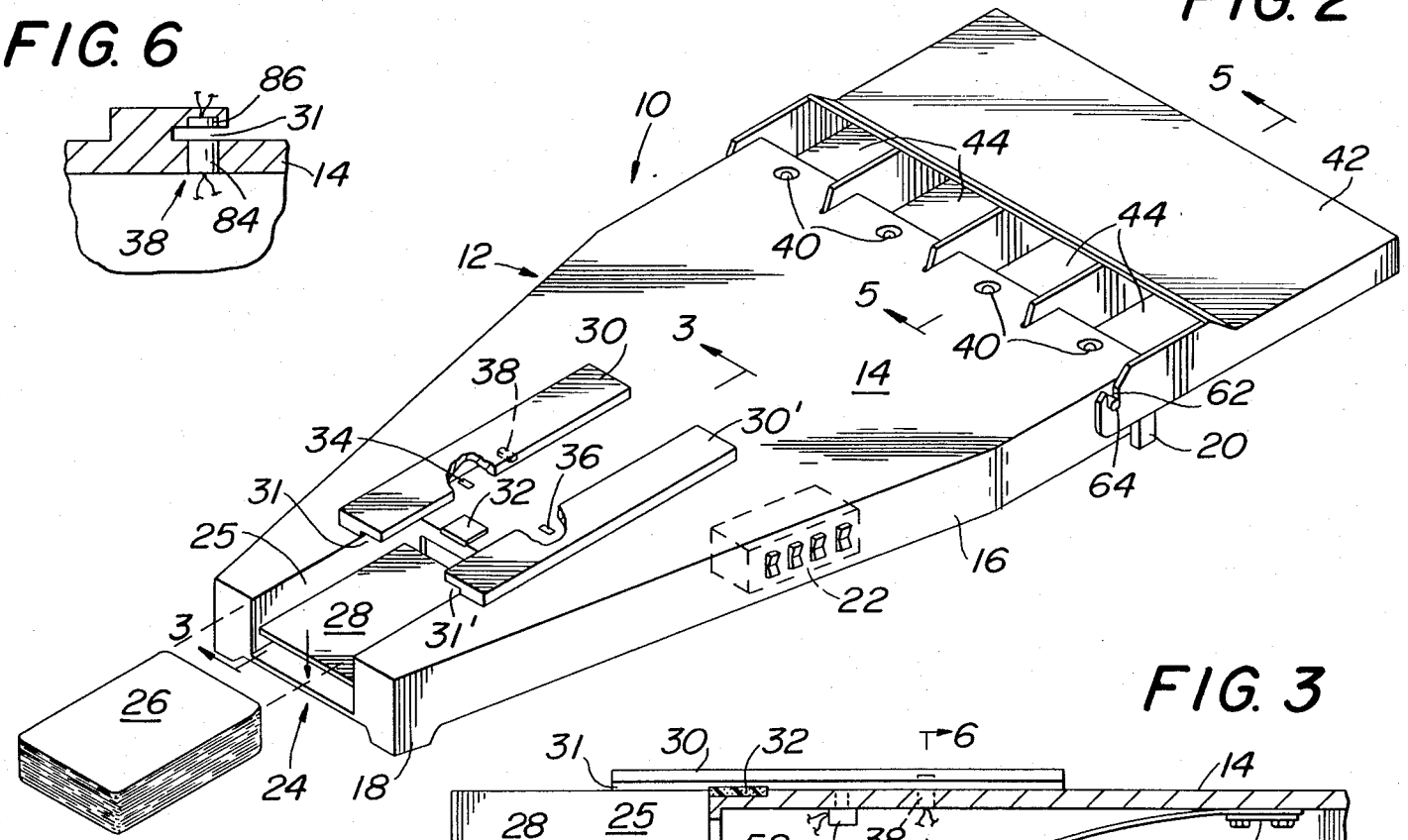
FIG. 2 illustrates one embodiment of the card dealing apparatus in accordance with the present invention.
FIG. 3 is a sectional view of the first embodiment taken along the line 3—3 of FIG. 2.
FIG. 6 is a sectional view taken along the line 6—6 of FIG. 3, illustrating the card presence sensor.

Referring to FIG. 2, manual dealer 10 consists of a housing 12, which may be supported by feet 18 and 20. A card receiver 24 is located at one end of housing 12 for receiving a deck 26 of playing cards. Side walls 25 and platform 28 define the card receiver 24, which is sized to accept a standard deck of playing cards. Card receiver 24 is open at the top so that an operator may manually slide cards off the top of the deck 26 one at a time through dealer 10.

Immediately adjacent card receiver 24 are card guides 30, 30′, which are mounted on top wall 14 of housing 12. Guides 30, 30′ are undercut at 31, 31′ to define a channel just wide enough to accommodate the width of a card. The height of undercuts 31, 31' is presently preferred to be approximately 1.5 times the thickness of a standard playing card to ensure that only one card at a time may be moved under guides 30, 30'. A friction pad 32, which may be of rubber or other high friction material, is located between guides 30, 30' on top wall 14 adjacent card receiver 24. Friction pad 32 serves to insure that only one card at a time is dealt from deck 26.

As best seen in FIG. 3, platform 28 is biased upwardly by leaf spring 46 so that the top card of deck 26 is always at the proper height for dealing. Leaf spring 46 is attached at one end to platform 28, as at 48, and is attached at the other end to the under side of housing top wall 14, as at 50. Although a leaf spring is illustrated, it will be appreciated that any other means for biasing platform 28 upward, such as a coil compression spring, may be used without departing from the present invention.

Two photocells 34 and 36 are located flush with top wall 14 beneath guides 30 and 30' respectively. Photocells 34 and 36 scan the code bars marked on the faces of the cards in deck 26 as the cards are dealt. A card presence detector 38 is located beneath guide 30 on the side of photocell 34 furthest from card receiver 24. As more clearly shown in FIG. 6, card presence detector 38 comprises a light source 84 and a photodetector 86. When the manual dealer 10 is in use, light source 84 is continuously energized to provide a constant beam of light which strikes photocell 86, except when a card is being moved through guides 30, 30'. The operation of card presence detector 38 is described more fully below.

A card carrier 42 is removably attached to manual dealer 10 at the end of housing 12 opposite card receiver 24. Notches 62 in card carrier 42 cooperate with pins 64 on side wall 16 of housing 12 to removably engage card carrier 42 with housing 12.

Figure 5:
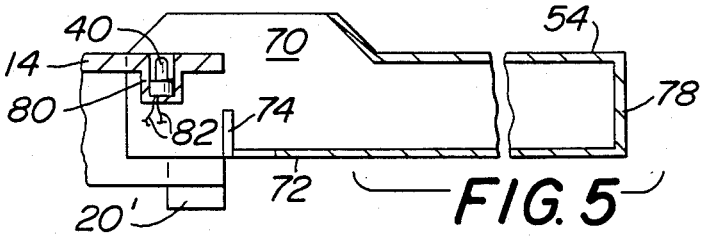
FIG. 5 is a sectional view of the first embodiment taken along the line 5—5 of FIG. 2.

Card carrier 42 has a plurality of pockets or bins 44 for receiving cards dealt by the operator. Four pockets are illustrated, since Duplicate Bridge is played in groups of four players. However, any other number of pockets may be provided as required for the particular game being played. Indicator lights 40, in the present embodiment light emitting diodes or LEDs, are located in top wall 14 of housing 12 adjacent pockets 44 of card carrier 42. As best seen in FIG. 5, indicator lights 40 are located in recesses 80 in housing top wall 14. Lead wires 82 are provided to energize indicator lights 40 as required.

Figure 4:
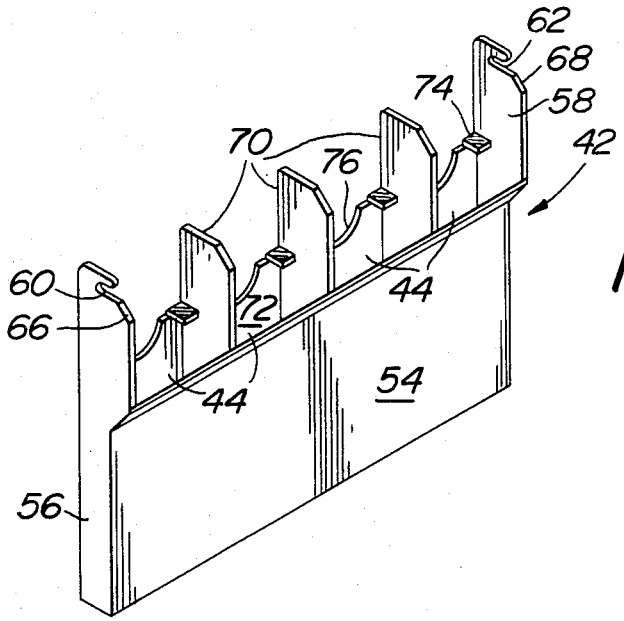
FIG. 4 illustrates in greater detail the removable card carrier of the embodiment shown in FIG. 2.

Card carrier 42 is shown in greater detail in FIG. 4. Carrier 42 consists of front wall 54, side walls 56 and 58, and rear wall 72. A plurality of intermediate walls 70, which are parallel to side walls 56 and 58, divide the interior of carrier 42 into a plurality of card pockets 44. Projections 74, which are generally perpendicular to back wall 72, serve to hold the cards in pockets 44 as the carrier is removed from dealer 10 and as it is carried from one table to another during tournament play. Notches 76 are provided in rear wall 72 at each pocket location to facilitate grasping and removal of the cards. As previously described, side walls 56 and 58 have slots 60 and 62, respectively, at one end thereof for attaching carrier 42 to dealer 10. Side walls 56 and 58 have bevels 66 and 68, respectively, as do side wall 70, to facilitate attachment and removal of carrier 42 to dealer 10.

A row of switches 22 is located on side wall 16 of housing 12. Switches 22 are used to apply power to manual dealer 10 and to select one of a number of predetermined modes of operation and memory locations, as described more fully below.

Housing 12 also contains a microprocessor and associated circuitry (not shown) for processing the code read from the cards and for actuating the appropriate indicator lights 40.

Figure 11A:
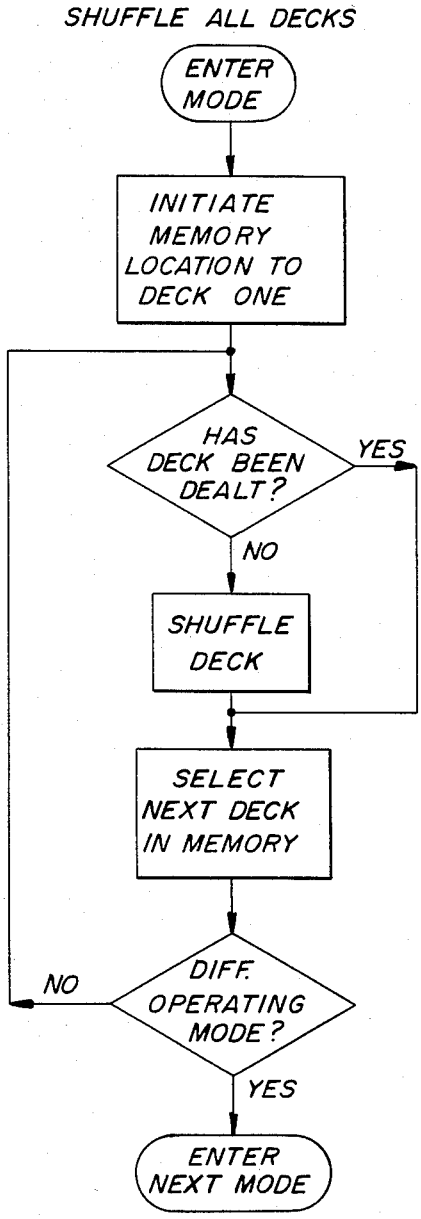
FIGS. 11*a*, 11*b*, 11*c*, 11*d*, 11*e*, 11*f* and 11*g* are Functional Flowchart representations of the preferred method of operation of the microprocessor portion of the present invention.
Figure 11B:
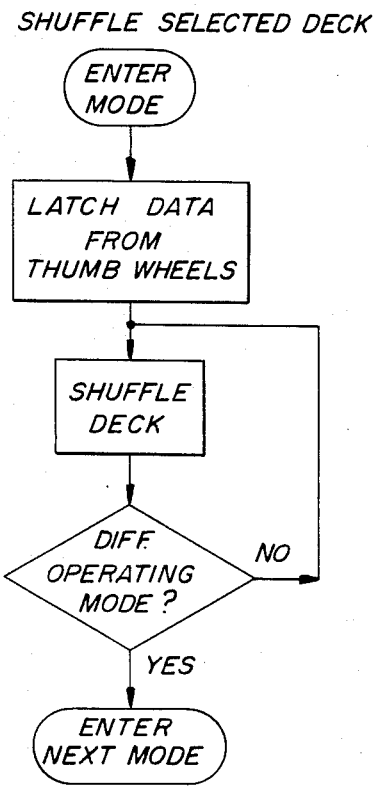
Figure 11C:
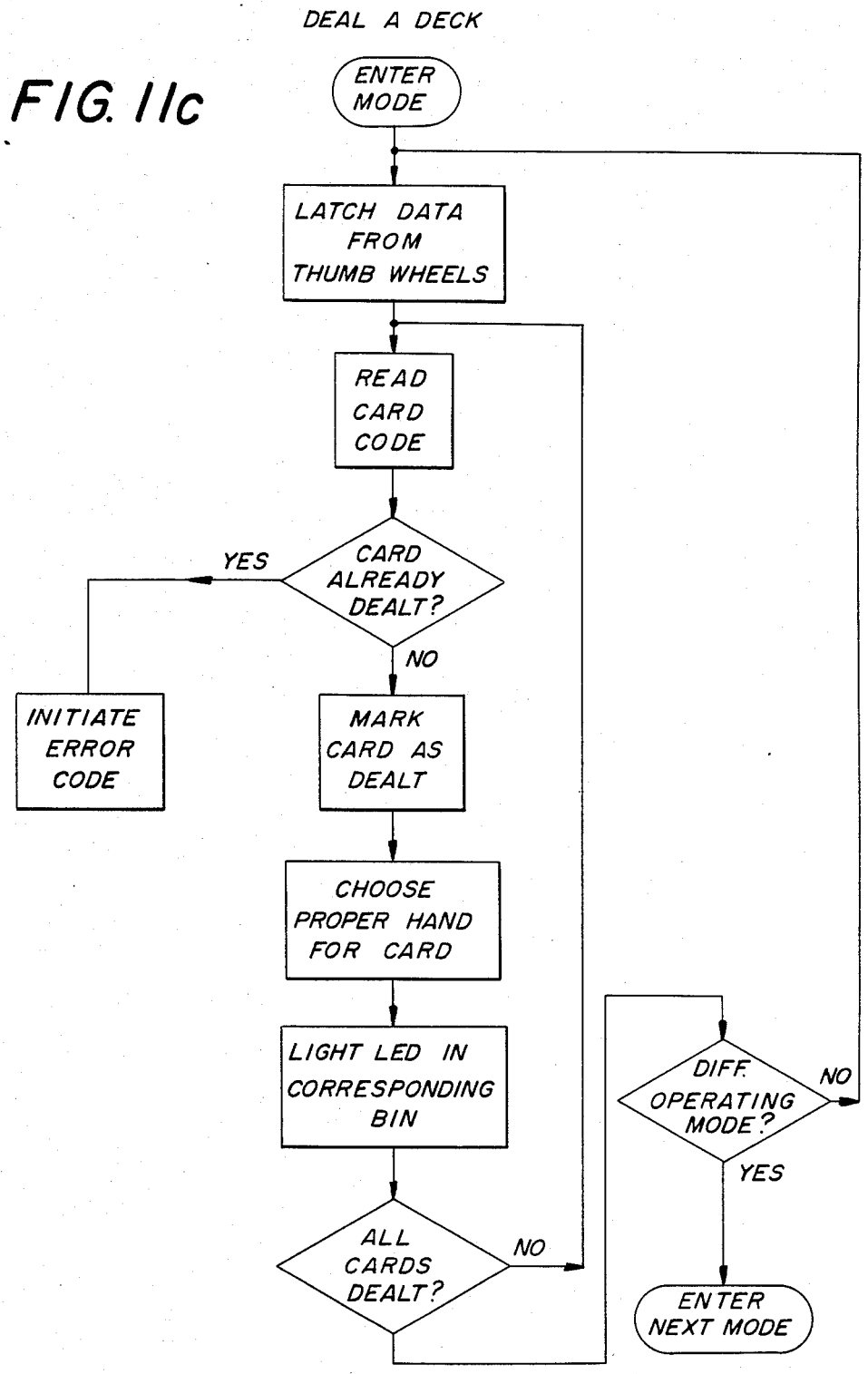
Figure 11D:
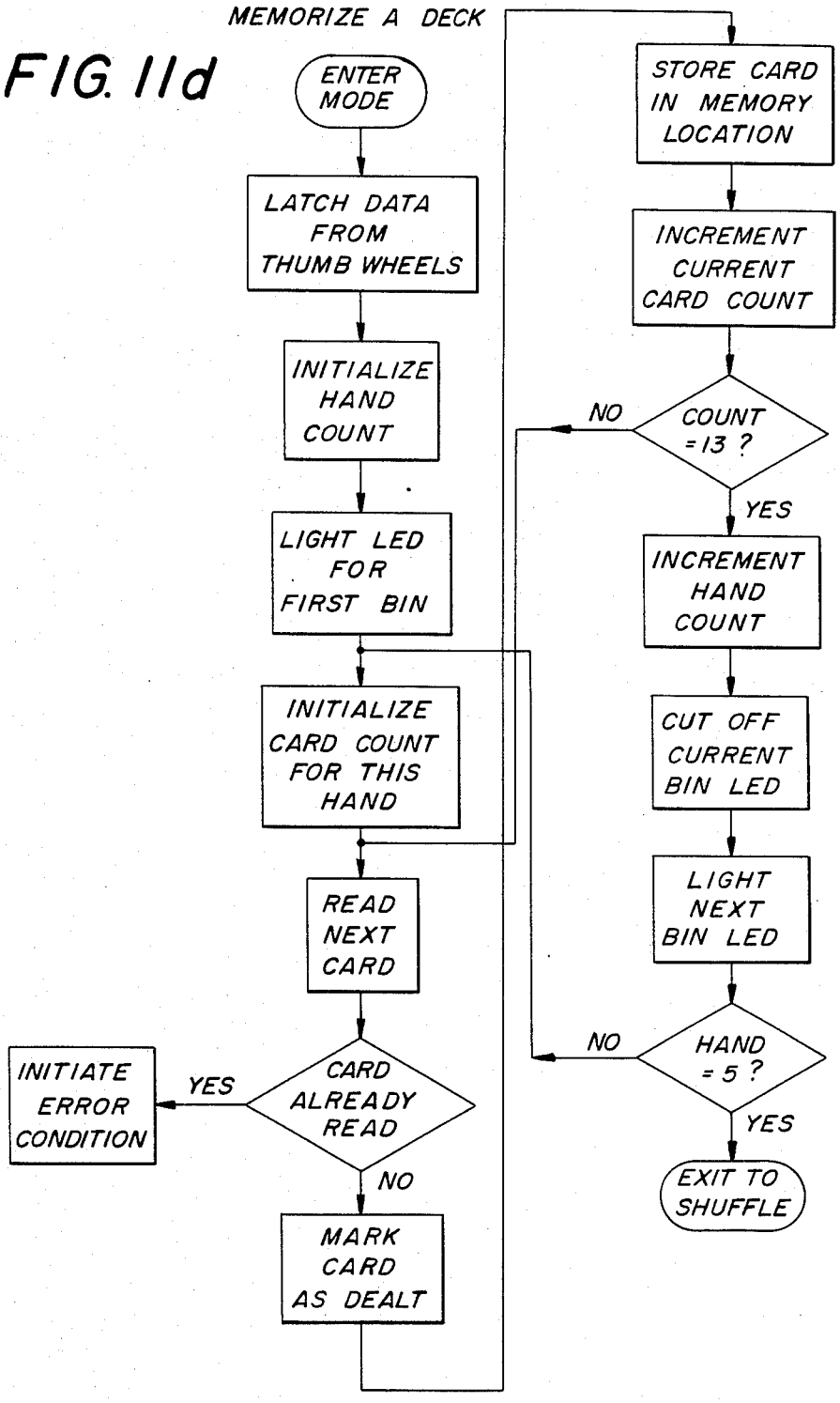
Figure 11E:
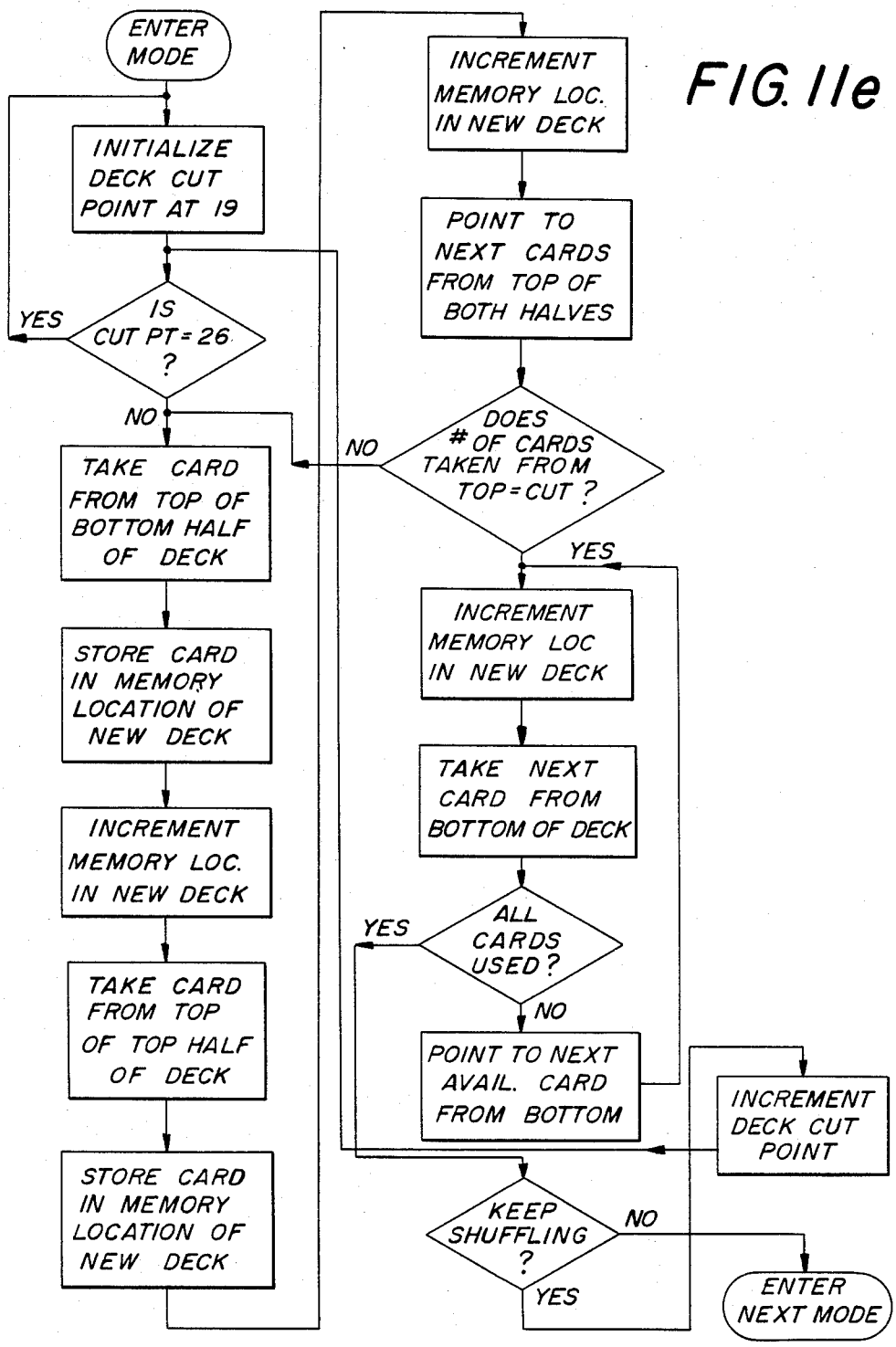
Figure 11F:
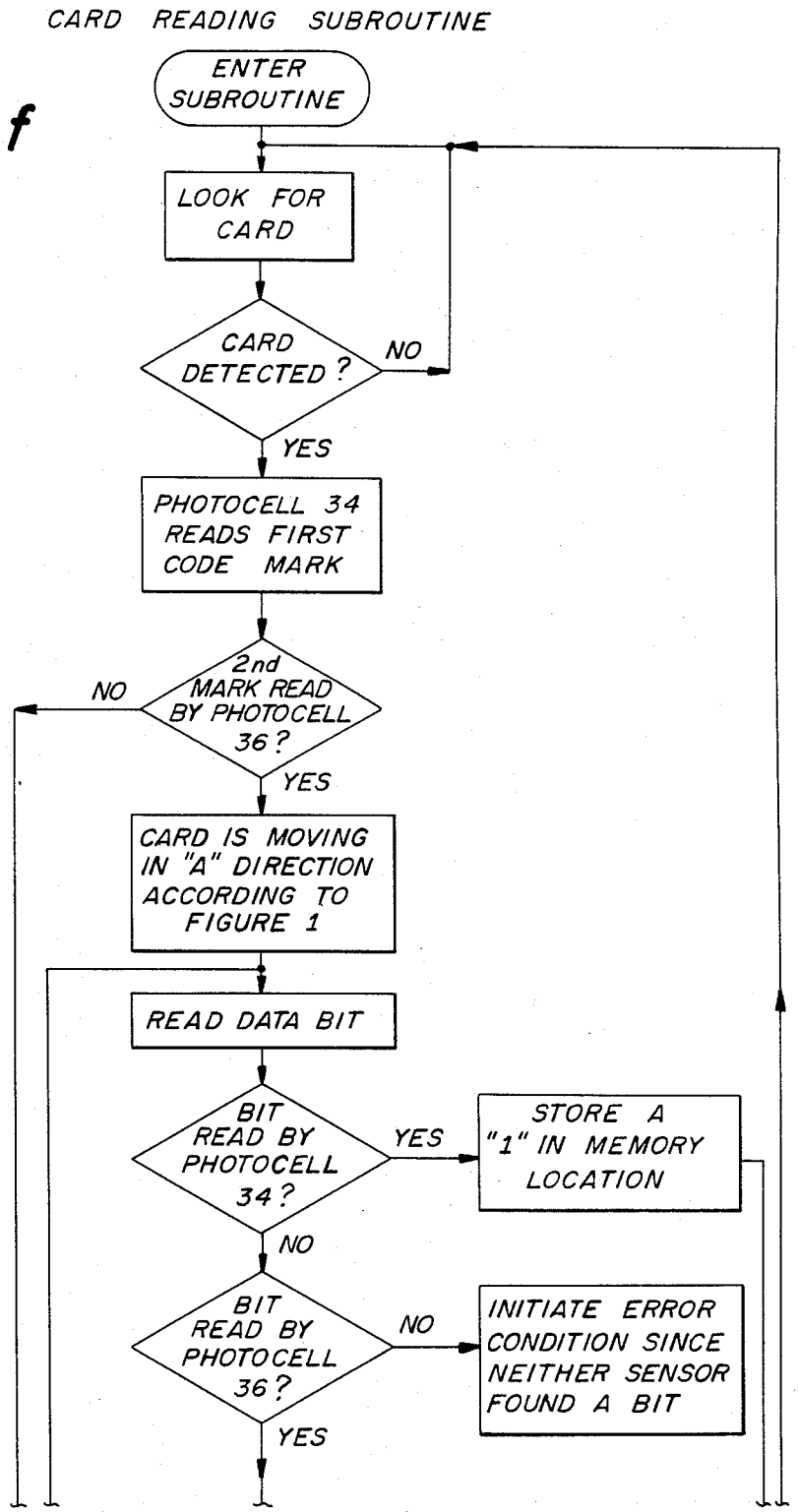
Figure 11G:
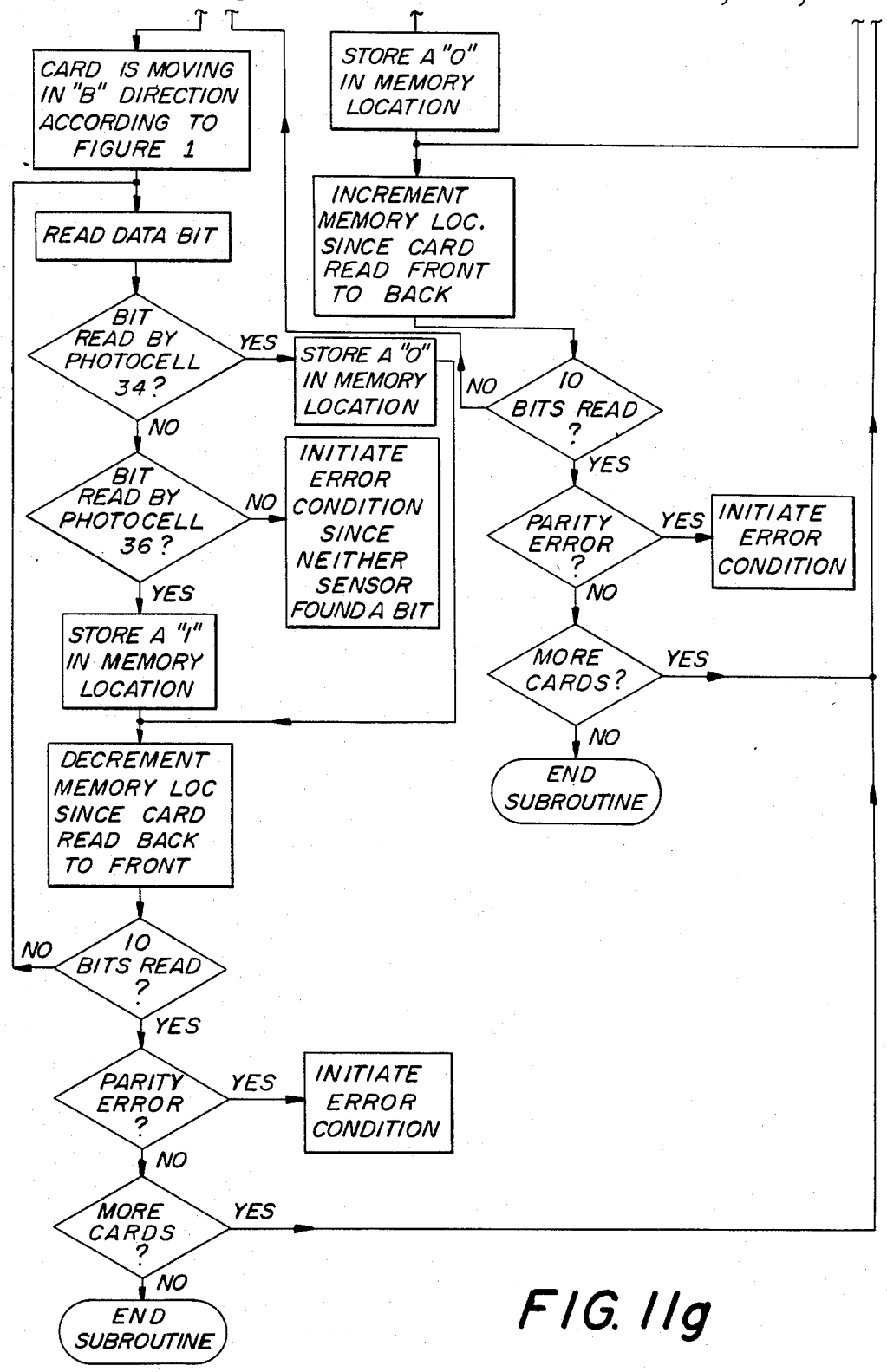

As presently preferred, the microprocessor is provided with memory locations to store seven decks of cards, although it will be appreciated that any number of decks may be stored as long as sufficient memory capacity is provided. The microprocessor is arranged to manipulate the stored decks in one of four operating modes, as follows:

1. Shuffle All Decks. This is the mode the microprocessor will enter when power is applied, and is the mode the microprocessor will return to upon completion of the other modes. In this mode, as illustrated schematically by the Flowchart of FIG. 11*a*, the microprocessor selects the first of the seven decks in memory. If that deck has not already been dealt, the microprocessor shuffles the deck in the manner illustrated by the shuffling subroutine Flowchart shown in FIG. 11*e*. The microprocessor repeats this process for all seven decks. When all decks have been shuffled, the microprocessor returns to the first deck and repeats the process until a different operating mode is selected. The microprocessor shuffles each deck at an approximate rate of 200 shuffles per second.

2. Shuffle Selected Deck. In this mode, as illustrated schematically by the Flowchart of FIG. 11*b*, only one of the seven decks in memory is shuffled. The number of the deck to be shuffled is selected by one of the switches 22, which may be thumbwheel switches, for example. The microprocessor will shuffle only the deck selected by the operator.

3. Deal A Deck. In this mode, as shown schematically by the Flowchart of FIG. 11*c*, a selected one of the seven decks is stored in memory. The number of the deck to be dealt is selected by one of the switches 22. As coded cards are read, the microprocessor will look up the card in memory and illuminate the indicator light 40 associated with the hand to which the card is to be dealt. This process continues for all cards in the deck.

4. Memorize A Deck. This last mode, which is shown schematically by the Flowchart of FIG. 11*d*, memorizes the order in which cards are dealt so that the same hand may be dealt later. The memory location in which the hand is to be stored is selected by one of the switches 22. Cards from a coded deck are manually passed through the dealer. As coded cards are read, the microprocessor will memorize the card and store it for later recall in the "Deal A Deck" mode. The microprocessor is programmed to place the first thirteen cards in the first hand, the next thirteen cards in the second hand, and so on. Thus, when the first card is read, the microprocessor will illuminate the indicator light 40 corresponding to the first hand. The indicator light will remain illuminated until the first thirteen cards have been read. The microprocessor will then extinguish the light and illuminate the light for the second hand until the next thirteen cards are dealt, and so on, until the entire deck has been dealt.

Operation of the manual dealer will now be described. For purposes of the following description, it will be assumed that the dealer is operating in the "Deal A Deck" mode.

A deck 26 of playing cards is placed face down on platform 28 in card receiver 24. The operator deals one card at a time from the top of deck 26 by pushing the top card to the right, with reference to FIG. 2, over friction pad 32, which holds back cards below the top and serves to insure that only the top card of deck 26 is dealt. As the card is moved to the right between guides 30, 30', the forward edge of the card passes between light source 84 and photodetector 86 of card presence detector 38, thereby blocking the light from light source 84 to photocell 86. This signals the microprocessor that a card is ready to be read by photocells 34 and 36.

As the card continues to move to the right, the first code marks to be detected by photocells 34 and 36 are the direction precode marks. It will be apparent that, as a result of random arrangement of the coded cards from previous play or shuffling the coded deck before dealing, a card may move through the guides in either of two directions, designated as the "A" direction and "B" direction in FIG. 1. If the card is moving through the dealer 10 in the "A" direction, the bars representing binary zeros will pass over photocell 36 and the bars representing binary ones will pass over photocell 34. On the other hand, if the card is moving through the dealer 10 in the "B" direction, the bars representing the binary ones will pass over photocell 36 while the marks representing binary zeros will pass over photocell 34. Thus, in order to properly read the binary ones and zeros, it is necessary for the microprocessor to know which photocell is scanning the binary ones and which is scanning the binary zeros. This information is provided by the direction precode marks. As presently preferred, and as shown schematically by the card tending subroutine Flowchart of FIGS. **11*f* and 11*g*, the microprocessor will look for a code mark to appear first at photocell 36. The "A" direction precode has one code mark picked up by photocell 36 after the first code mark is sensed by photocell 34. The "B" direction precode has one code mark which is read by photocell 34 after the first code mark is sensed by the same photocell. Accordingly, when the card is moving through in the "A" direction, the microprocessor will interpret code marks sensed by photocell 36 as binary zeros and the code marks sensed by photocell 34 as binary ones, whereas if the card is moving in the "B" direction, the microprocessor will interpret code marks sensed by photocell 36 as binary ones the code marks sensed by photocell 34 as binary zeros. Accordingly, the microprocessor will correctly construct the binary word representative of the identity of the card, including the error code, without regard to the direction in which the card is moving through the dealer 10**.

In addition to being insensitive to the direction in which the card moves through the dealer, the apparatus is also insensitive to the speed with which the card moves through the dealer. Since positive markings represent both binary ones and binary zeros, and since binary ones are sensed by one photocell and binary zeros by a second photocell, complex problems of timing are avoided. Thus, for example, if zeros were indicated by the absence of a mark in a particular location, it would be necessary to know the speed of the card as it moves through the dealer in order to sense the presence or absence of a code mark at a particular spot on the card. Since the present invention uses a positive coding, i.e., only the presence of the mark represents a binary one or binary zero, no timing reference is necessary to determine the presence or absence of a code mark at a particular card location. Such a system minimizes the potential for errors in reading the code and permits the cards to be dealt as quickly or as slowly as desired.

After the card has passed completely over photocells 34 and 36, the microprocessor compares the identity of the card from the code read by photocells 34 and 36 to the predetermined hand stored in memory to determine to which player position the card should be dealt. The microprocessor illuminates one of the indicator lights 40 to indicate which player position should receive the card. The operator then simply places the card in the pocket 44 which corresponds to the illuminated indicator light 40. The operator will continue this procedure through the entire deck, placing the cards into the pockets according to the illumination of indicator lights 40. If the microprocessor detects an error in reading the card (by means of the Hamming error code), it can signal the operator by any appropriate means, such as by causing all of the indicator lights to blink. If an error is detected, the operator can simply replace the card in the deck and repeat the deal.

After all the cards have been dealt, with the appropriate number of cards going to each of the player positions, card carrier 42 can be removed by disengaging slots 62 from pin 64. Card carrier 42 can then be taken to the proper table for play.

The microprocessor may also be programmed, as shown by the Deal A Deck Flowchart of FIG. **11*c***, to keep track of the cards which have already been dealt, so that if a particular card has already been dealt, the microprocessor will not allow another card to be read as that particular card through error. This provides an additional check of accuracy.

The Automatic Dealer

A second embodiment of a card dealing apparatus in accordance with the present invention is shown in FIGS. 7–10. The second embodiment automatically deals cards to the appropriate location. For convenience, the second embodiment will be referred to as the automatic dealer.

Figure 7:
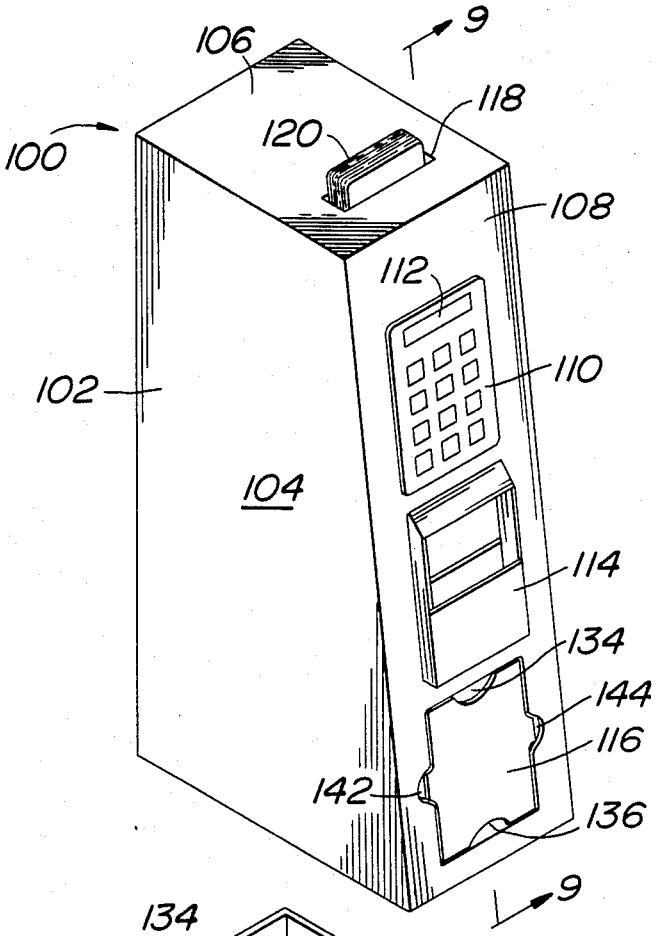
FIG. 7 illustrates a second embodiment of the card dealing apparatus in accordance with the present invention.

Referring to FIG. 7, automatic dealer 100 consists of a housing 102 having a top wall 106, a side wall 104 and a front wall 108. The side wall opposite wall 104 and the rear wall are not shown. Top wall 106 of housing 102 has an opening 118 in which is inserted a deck 120 of coded playing cards. A control panel 110 is located on housing front wall 108. Control panel 110 may be used to apply power to the automatic dealer 100 and to select the appropriate operating mode. Control panel 110 may include an alphanumeric display 112 for displaying messages, such as mode selected or error in reading a card, to the operator. Located below control panel 110 is an error bin 114 to receive cards ejected by the automatic dealer whenever an error in reading the cards is detected. At the bottom of front wall 108 is located card carrier 116 for receiving the cards dealt by the automatic dealer in a manner analogous to the card carrier described above in connection with the manual dealer.

Figure 9:
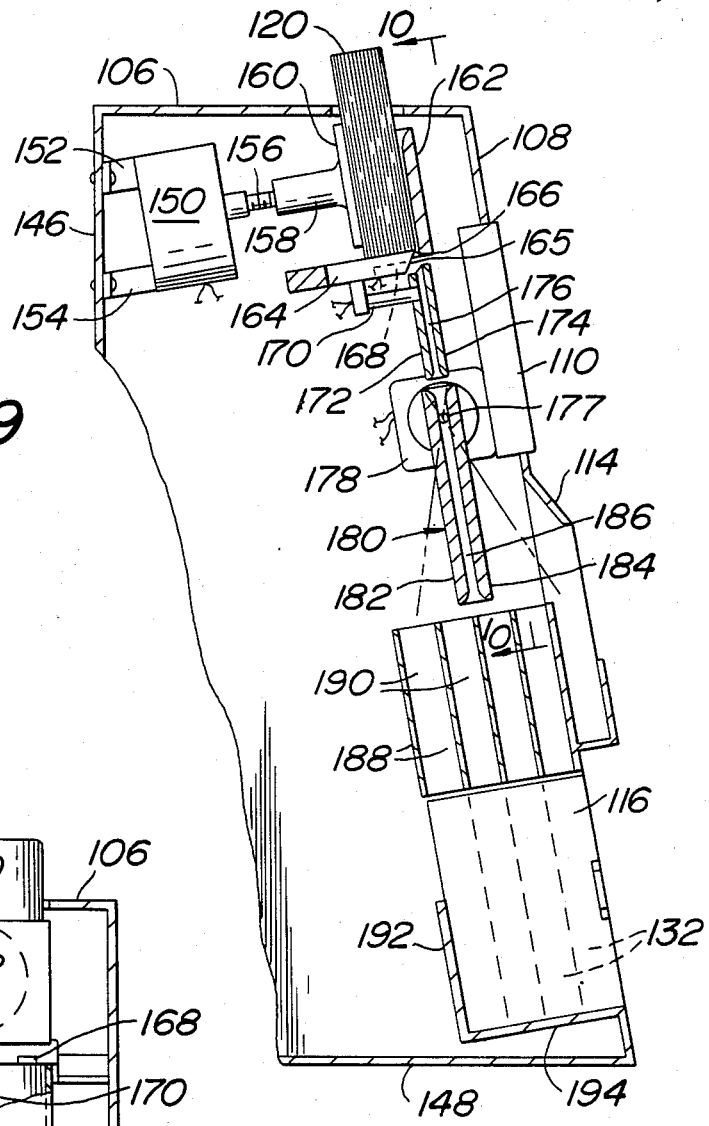
FIG. 9 is a cross-section view of the second embodiment taken along the line 9—9 of FIG. 7, showing the internal details of the second embodiment.
Figure 10:
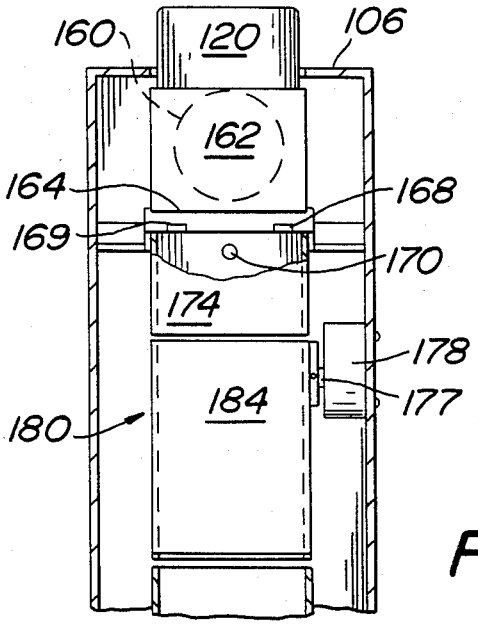
FIG. 10 is a sectional view taken along the line 10—10 of FIG. 9.

The internal details of automatic dealer 100 are more clearly shown in FIGS. 9 and 10. An electric motor 150 is mounted on housing rear wall 146 near the top thereof by mounting brackets 152 and 154. Motor 150 has a screw-thread shaft 156 which engages one end of coupling 158. A push plate 160 is integral with the opposite end of coupling 158. A support plate 164 is mounted in any suitable fashion on the interior of the housing and is located below and perpendicular to push plate 160. Orientation plate 162 is also suitably mounted on the interior of housing 102 and serves to insure that the cards being dealt are in proper registration for movement through card guides, as more fully described below. Support plate 164 is undercut at 165 to provide a sharp edge. Edge 165 and orientation plate 162 define a gap 166 through which cards move, as more fully described below.

Card presence detector 170 is located beneath and parallel to support plate 164. The surface of photocell 170 is parallel to and flush with card guide 172. Photocells 168 and 169 are provided to read coded cards in a manner identical to that described in connection with the first embodiment of the invention. Photocells 168 and 169 are located in support plate 164 flush with bevel 165.

Parallel to card guide 172 is card guide 174. Guides 172 and 174 define a channel 176 for movement of a card in a downward direction. The spacing between guides 172 and 174 is such that channel 176 is wide enough to admit only a single card at a time. Below guides 172 and 174 is located card distributor 180. Card distributor 180 consists of guides 182 and 184. Guides 182 and 184 are parallel and define a channel 186 between them. The width of channel 186 is not critical. Card distributor 180 is mounted at one end for pivotal movement on shaft 177 of stepping motor 178. As will be described in greater detail below, stepping motor will pulse either clockwise or counterclockwise through an appropriate number of steps to bring the lower end of card distributor 180 into position over one of the four pockets 132 of card carrier 116, or in a position over error bin 114.

Located below card distributor 180 is a plurality of guides 188 which are parallel with front wall 108 and intermediate walls 130 of card carrier 116. Guides 188 define a plurality of chutes 190 between them which serve to facilitate movement of the cards from the card distributor 180 into card carrier 116.

Figure 8:
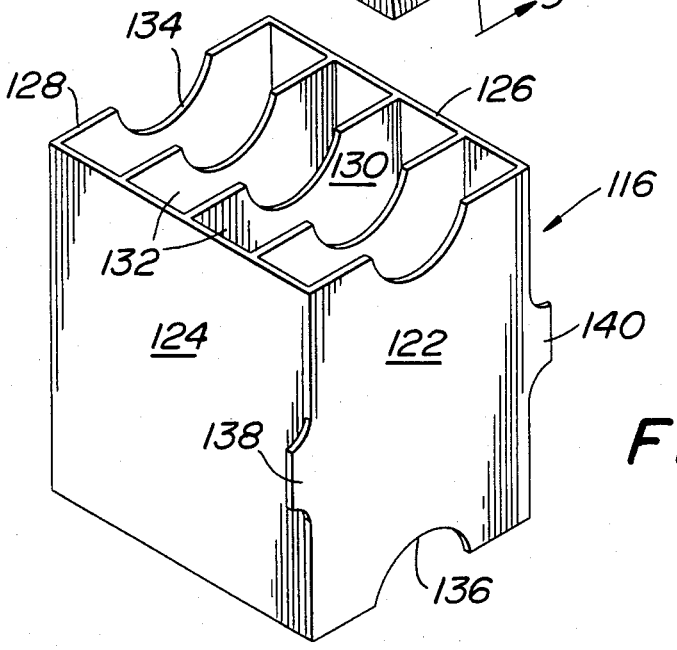
FIG. 8 illustrates in greater detail the removable card carrier used in the second embodiment.

As best seen in FIG. 8, card carrier 116 consists of front wall 122, side walls 124 and 126 and rear wall 128. A plurality of intermediate walls 130, which are parallel to front wall 122 and rear wall 128, divide the interior of the card carrier 162 into a plurality of pockets 132. Notches 134 are provided in front wall 122, rear wall 128 and intermediate walls 130 to facilitate grasping and removal of the cards. Tabs 138 and 140 cooperate with notches 142 and 144 in housing front wall 108 to facilitate insertion and removal of carrier 116 with respect to housing 102.

Operation of the automatic dealer 100 will now be described, using the "Deal A Deck" mode for illustration.

A deck 120 of coded playing cards is inserted into opening 118 on top wall 106. The deck is inserted with the cards facing toward push plate 160. Automatic dealer 100 is then turned on by means of an appropriate push button on control panel 110. Motor 150 is thereupon energized and begins to slowly turn threaded shaft 156. As shaft 156 turns, it causes push plate 160 to move to the right, with reference to FIG. 9, moving deck 120 toward orientation plate 162. Orientation plate 162 puts no pressure on deck 120, but merely serves to align the top card in the deck with gap 166. As deck 120 continues to move to the right, it will reach a point where the top card in the deck approaches the edge 165 of support plate 164. As deck 120 continues to move, the top card will move past edge 165 and begin to drop, by means of gravity, through gap 166 and into channel 176 between guides 172 and 174. As the card drops, it will move past card presence detector 170 and photocells 168 and 169, which will read the code in the same manner as described in connection with the first embodiment of the invention.

As the card falls further, it moves into channel 186 of card distributor 180. Card distributor 180 is moved into one of five positions (one of four player locations plus the error bin) by stepping motor 178. Stepping motor 178 is pulsed either clockwise or counterclockwise the appropriate number of steps to bring card distributor 180 over the appropriate pocket by means of a command from microprocessor circuitry (not shown). The microprocessor circuitry compares the code read from the card against the predetermined hand and signals stepping motor 178 to move the card distributor 180 to deliver the card to the appropriate player location. Card distributor 180 waits over the appropriate player location for a predetermined time to insure that the card will fall into the proper pocket before the next card is dealt.

As the card falls past card presence detector 170, the microprocessor signals motor 150 to turn off and wait for a predetermined period of time before resuming motion to allow sufficent time for the card to drop into the appropriate pocket before the next card begins its downward motion past the photocells. The entire deck is then dealt in this manner.

After the entire deck has been dealt and all of the cards distributed to the appropriate player location, the card carrier 116 is removed from housing 102 by grasping carrier 116 at notches 134 and 136 and withdrawing it from housing 102. The card carrier may then be taken to the next table for play.

In addition to dealing cards in accordance with a predetermined program, the second embodiment of the invention may, like the first embodiment, randomly deal cards and memorize the hands to which they are dealt, or may deal cards in any manner programmed into the microprocessor.

The present invention may be embodied in other specific forms without departing from the spirit or essential attributes thereof and, accordingly, reference should be made to the appended claims, rather than to the foregoing specification, as indicating the scope of the invention.

We claim:

1. Apparatus for dealing coded playing cards in accordance with at least one predetermined hand, comprising:

a housing, an opening in the housing for introducing at least one coded playing card into the apparatus, means for electro-optically reading the coded cards one at a time as the coded cards are moved manually past the reading means, card guide means operatively associated with the reading means for guiding only one card at a time past the reading means, a pad of high-friction material located approximately in the center of the card guide means for preventing more than one card at a time from entering the card guide means, means for comparing the code read from each card against the predetermined hand to determine to which player position the card should be dealt, and indicating means to provide a visual indication of which player position the card should be dealt to.

2. Apparatus according to claim 1 where the high-friction material is rubber.

3. Apparatus for dealing coded playing cards in one of a plurality of modes, comprising:

a housing, an opening in the housing for introducing at least one coded playing card into the apparatus, means for electro-optically reading the coded cards one at a time as they are moved manually past the reading means, card guide means operatively associated with the reading means for guiding only one card at a time past the reading means, means for selecting one of the plurality of modes, means for processing the code read from each card in a predetermined manner according to the mode selected, and memory means for storing information about the coded cards, wherein in one of the operating modes the order in which the coded cards are moved past the reading means is stored in the memory means for later recall.

4. Apparatus for automatically dealing coded playing cards in accordance with at least one predetermined hand, comprising:

a housing, an opening in the housing for inserting a deck of coded playing cards, means for electro-optically reading the coded cards one at a time as the coded cards move past the reading means, card guide means operatively associated with the reading means for guiding only one card at a time past the reading means, means for automatically introducing the cards one at a time into the guide means, comprising a stationary plate means generally parallel to and in longitudinal alignment with the guide means, a movable plate means generally parallel to the guide means and movable in a direction substantially perpendicular to the longitudinal axis of the guide means, and motor means operatively associated with said movable plate means for incrementally moving the movable plate means toward the guide means, means for comparing the code read from each card against the predetermined hand to determine to which player position the card should be dealt and to generate a control signal representative of that player location, and distributor means responsive to the control signal for receiving the card from the card guide means and moving the card to the appropriate player location.

5. Apparatus according to claim 4 further comprising means generally perpendicular to the movable plate means for supporting the deck of playing cards.

6. Apparatus for automatically dealing coded playing cards in one of a plurality of modes, comprising:

a housing, an opening in the housing for inserting a deck of coded playing cards, means for electro-optically reading the coded cards one at a time as the coded cards move past the reading means, card guide means operatively associated with the reading means for guiding only one card at a time past the reading means, means for automatically introducing the cards one at a time into the guide means, means for selecting one of the plurality of modes, means for processing the code read from each card in a predetermined manner according to the mode selected, display means for visually displaying the mode selected, and memory means for storing information about the coded cards, wherein in one of the operating modes the order in which the coded cards move past the reading means is stored in the memory means for later recall.

* * * * *